US009726016B2

(12) United States Patent
Wilmot et al.

(10) Patent No.: US 9,726,016 B2
(45) Date of Patent: Aug. 8, 2017

(54) PROXIMITY AWARENESS SAFETY DEVICE AND SYSTEM

(71) Applicant: Minetec Pty Ltd, Willetton (AU)

(72) Inventors: Grant Wilmot, Willetton (AU); Alex Beliakov, Willetton (AU); Sunil Sanganbatte, Willetton (AU); Craig Wroth, Willetton (AU)

(73) Assignee: Minetec Pty Ltd, Willetton, WA (US)

( * ) Notice: Subject to any disclaimer, the term of this patent is extended or adjusted under 35 U.S.C. 154(b) by 120 days.

(21) Appl. No.: 14/441,476

(22) PCT Filed: Nov. 7, 2013

(86) PCT No.: PCT/AU2013/001286

§ 371 (c)(1),
(2) Date: May 7, 2015

(87) PCT Pub. No.: WO2014/071451

PCT Pub. Date: May 15, 2014

(65) Prior Publication Data

US 2015/0308270 A1 Oct. 29, 2015

(30) Foreign Application Priority Data

Nov. 7, 2012 (AU) ..... 2012904901

(51) Int. Cl.

| | |
|---|---|
| ***E21F 17/18*** | (2006.01) |
| ***G08G 1/16*** | (2006.01) |
| ***H01F 7/20*** | (2006.01) |

(52) U.S. Cl.

CPC ..... *E21F 17/18* (2013.01); *G08G 1/166* (2013.01); *H01F 7/202* (2013.01)

(58) Field of Classification Search

CPC ..... E21F 17/18; G08G 1/166; H01F 7/202
See application file for complete search history.

(56) References Cited

U.S. PATENT DOCUMENTS

| | | | |
|---|---|---|---|
| 8,232,888 | B2 | 7/2012 | Frederick et al. |
| 8,289,170 | B2 | 10/2012 | Pryor et al. |

(Continued)

FOREIGN PATENT DOCUMENTS

| | | | |
|---|---|---|---|
| AU | 2008316786 | A2 | 2/2011 |
| AU | 2010241545 | A1 | 10/2011 |

(Continued)

OTHER PUBLICATIONS

IMC Technical Services Limited, Improving the Safety of Workers in the Vicinity of Mobile Plant, Contract research report 358/2001, 2001, Health and Safety Executive, UK (http://www.hse.gov.uk/research/crr_pdf/2001/crr01358.pdf).

*Primary Examiner* — Richard Camby
(74) *Attorney, Agent, or Firm* — Mu P.C.

(57) ABSTRACT

A vehicle proximity awareness system in a mine, including: a magnetic field transmitter on a first vehicle for transmitting a transmit magnetic field, the magnetic field transmitter including an anti-collision capability for reducing a likelihood of the transmit magnetic field being affected by a magnetic field from a different source; a magnetic field receiver on a second vehicle for receiving the transmit magnetic field from the first vehicle to provide a receive signal; and a processor on the second vehicle for processing the receive signal, and for providing an indication to an operator of the second vehicle when the first vehicle is within a proximity of the second vehicle.

18 Claims, 12 Drawing Sheets

(56) References Cited

U.S. PATENT DOCUMENTS

| | | | |
|---|---|---|---|
| 8,446,277 | B2 | 5/2013 | Frederick |
| 2009/0109049 | A1 | 4/2009 | Frederick et al. |
| 2009/0267787 | A1 | 10/2009 | Pryor et al. |
| 2010/0271214 | A1 | 10/2010 | Frederick |
| 2011/0249118 | A1 | 10/2011 | Bruno |
| 2012/0127924 | A1 | 5/2012 | Bandyopadhyay et al. |
| 2012/0268261 | A1 | 10/2012 | Frederick et al. |
| 2014/0155098 | A1* | 6/2014 | Markham ..... H04B 1/0064 455/456.3 |

FOREIGN PATENT DOCUMENTS

| | | | |
|---|---|---|---|
| AU | 2008316786 | B2 | 9/2013 |
| CA | 2797354 | A1 | 11/2010 |
| CN | 101855659 | A | 10/2010 |
| CN | 102439643 | A | 5/2012 |
| EP | 2210246 | A1 | 7/2010 |
| EP | 2210246 | B1 | 4/2013 |
| EP | 2608175 | A1 | 6/2013 |
| GB | 2481940 | A | 1/2012 |
| MX | 2011011460 | A | 4/2012 |
| WO | WO 2009055606 | A1 | 4/2009 |
| WO | WO 2009134868 | A2 | 11/2009 |
| WO | WO 2010122570 | A1 | 10/2010 |
| WO | WO 2010127077 | A1 | 11/2010 |
| ZA | 200802673 | A | 5/2010 |

* cited by examiner

PROXIMITY AWARENESS SAFETY DEVICE AND SYSTEM

TECHNICAL FIELD

This invention relates to a proximity awareness system for improving safety in a mine.

INCORPORATION BY REFERENCE

This patent application claims priority from:

Australian Provisional Patent Application No 2012904901 titled "A Safety Device" filed 7 Nov. 2012.

The entire content of this application is hereby incorporated by reference.

BACKGROUND ART

In modern mining, safety is one of the most important issues. With increasing density of vehicles on mining sites, it is essential to have a proximity awareness system to reduce the risk of vehicle collisions. In particular, there are large mining vehicles (such as trucks for transporting ores or soils), which are several times larger than a utility and/or personnel transport vehicles (such as a utility, four-wheel drive etc.) at a mining site.

A vehicle collision between a mining vehicle and a utility vehicle can result in fatalities (typically to the utility vehicle occupants) and often result in casualties to the driver and/or the passengers of the utility vehicle.

Further, due to the size and configuration of mining vehicles, it is challenging for the driver to observe the whole of the surroundings of the moving mining vehicle especially in confined surroundings such as those in underground mines, such as tunnels shared by both types of vehicles. If a speed restriction is applied to the mining vehicle, it will reduce the productivity of that mining vehicle.

Thus, there is a need for a proximity awareness system to reduce the risk of vehicle collision, in particular, those involving mining vehicles and utility vehicles.

There are known systems which attach a transceiver on each vehicle (working in the UHF and VHF range), such that when vehicles carrying the transceivers are within proximity to each other the drivers of each vehicle will be alerted. The transceivers provide a warning of imminent collision to vehicle operators, thus enabling early reaction and reducing likelihood of injuries to personnel or operators, and nil or less damage to vehicles and equipment. There are however limitations to the existing system, for example, the range over which these systems work or that since they are not co-ordinated in any way they can interfere with one another and that warnings can consequently be less timely or not occur at all.

It is the aim of the present invention to offer an alternative system or a system which improves the reliability of a vehicle proximity awareness system operating at a mining site.

BRIEF SUMMARY OF THE INVENTION

According to one aspect of the present invention, there is provided a vehicle proximity awareness system in a mine, including: a magnetic field transmitter on a first vehicle for transmitting a transmit magnetic field, the magnetic field transmitter including an anti-collision capability for reducing a likelihood of the transmit magnetic field being affected by a magnetic field from a different source; a magnetic field receiver on a second vehicle for receiving the transmit magnetic field from the first vehicle to provide a receive signal; and a processor on the second vehicle for processing the receive signal, and for providing an indication to an operator of the second vehicle when the first vehicle is within a proximity of the second vehicle.

In one form, the vehicle proximity awareness system further includes: a wireless communication link between the magnetic field transmitter and the different source; wherein the anti-collision capability is based on a communication through the wireless communication link to avoid having the magnetic field transmitter and the different source transmitting at a same time.

In one form, the wireless communication link is based on IEEE 802.11 standards.

In one form, the anti-collision capability is based on having the magnetic field transmitter to pause for a random time prior to a next transmission when the magnetic field from the different source is detected.

In one form, the anti-collision capability is based on a Time Division Multiple Access (TDMA) algorithm.

In one form, the magnetic field receiver is adapted such that the indication is capable of indicating a direction of the first vehicle relative to the second vehicle.

In one form, the indication is further capable of indicating whether the first vehicle is closer to the rear or front of the second vehicle.

In one form, the indication is further capable of indicating the number of any vehicle transmitting a magnetic field within the proximity of the second vehicle.

In one form, the vehicle proximity awareness system further includes: a WIFI module for transmitting from the second vehicle a WIFI signal back to the first vehicle alerting an operator of the first vehicle that the second vehicle is within a proximity of the first vehicle.

In one form, the magnetic field transmitter includes a coil positioned on substantially the top of the first vehicle, with a plane of the coil being substantially perpendicular to a movement direction of the first vehicle.

In one form, the magnetic field receiver includes two antennas positioned substantially perpendicular to each other.

In one form, the two antennas measure concurrently a Received Signal Strength Indication (RSSI) for one or more magnetic signals on two different channels.

In one form, the vehicle proximity awareness system further includes: a personnel magnetic field transmitter bearable by a mining worker; wherein the magnetic field receiver is capable of receiving a magnetic field transmitted from the personnel magnetic field transmitter.

In one form, the different source is a magnetic field transmitter on a third vehicle.

In one form, the vehicle proximity awareness system further includes: a wireless mesh network for tracking the first vehicle and/or the second vehicle.

In one form, the vehicle proximity awareness system further includes: a transceiver at a location for sending information to the first vehicle and/or the second vehicle when the first vehicle and/or the second vehicle is within a distance from the location.

In one form, the information includes a warning signal to the first vehicle and/or the second vehicle.

In one form, the location is an entrance to a mining tunnel.

According to another aspect of the present invention, there is provided a vehicle in a mine, including: a magnetic field transmitter for transmitting a transmit magnetic field, the magnetic field transmitter including an anti-collision capability for reducing a likelihood of the transmit magnetic field being affected by a magnetic field from a different source; the transmit magnetic field for providing a signal to another vehicle for processing to provide an indication to an operator of the other vehicle when the vehicle is within a proximity of the other vehicle.

According to another aspect of the present invention, there is provided a magnetic field transmitter for a proximity awareness system in a mine, including: a magnetic field transmitter for transmitting a transmit magnetic field, the magnetic field transmitter including an anti-collision capability for reducing a likelihood of the transmit magnetic field being affected by a magnetic field from a different source; the transmit magnetic field for providing a signal to a vehicle for processing to provide an indication to an operator of the vehicle when the magnetic field transmitter is within a proximity of the vehicle.

According to another aspect of the present invention, there is provided a method for implementing a vehicle proximity awareness system in a mine, including the steps of: transmitting from a first vehicle a transmit magnetic field; having at the first vehicle an anti-collision capability for reducing a likelihood of the transmit magnetic field being affected by a magnetic field from a different source; receiving at a second vehicle the transmit magnetic field to provide a receive signal; and processing the receive signal and providing an indication to an operator of the second vehicle when the first vehicle is within a proximity of the second vehicle.

DETAILED DESCRIPTION OF THE INVENTION

Figure 1A:
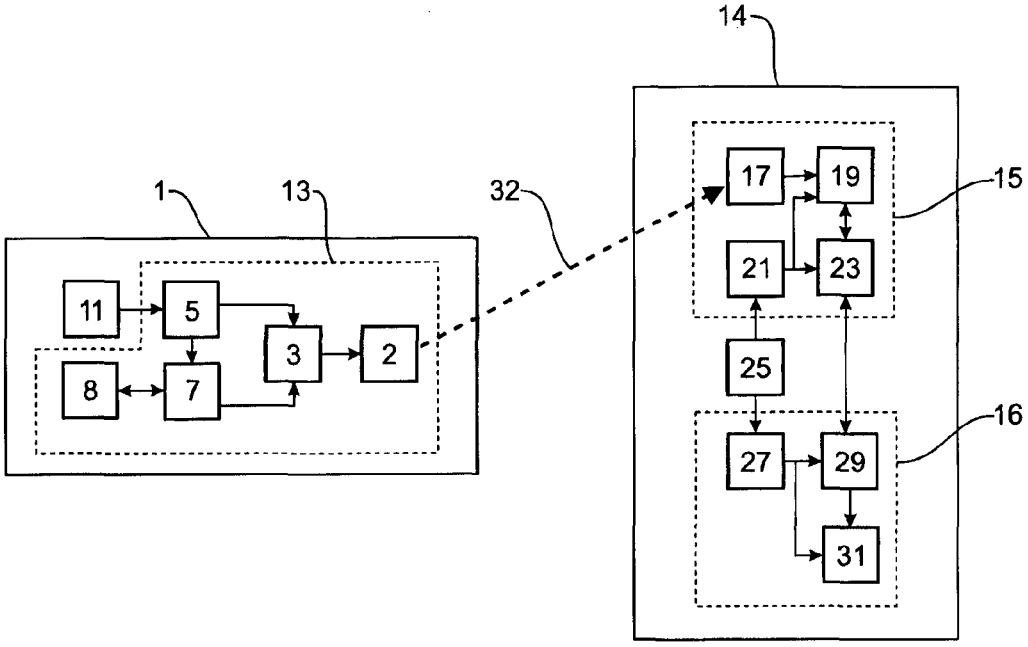
FIG. 1*a* depicts an embodiment of a vehicle and person proximity awareness system.

FIG. 1*a* depicts an embodiment of a vehicle and person proximity awareness system according to the present invention. Vehicle 1 includes a transmitter module 13, which is powered by a power source 11. Transmitter module 13 includes a transmitter 2, transmit electronics 3, power module 5, microcontroller 7, and an anti-collision module 8.

Power source 11 can be either the vehicle battery, or a power pack separate from the vehicle battery, or the combination of both. Power source 11 provides power to power module 5. Power module 5 provides power to both the microcontroller 7 and the transmit electronics 3. Microcontroller 7 controls transmit electronics 3 to produce a transmit signal (not shown). The transmit signal is sent to transmitter 2 for transmission. Transmit electronics 3 can generate the signal in various forms, and using for example, an H-bridge, various arrangements of switches, etc. The transmitter 2 can take many forms also, as long as it is considered by a person skilled in the art to be a magnetic field transmitter suitable for transmitting a transmit magnetic field 32, also known as transmit magnetic signal.

Anti-collision module 8 provides a function to the microcontroller which then uses that function to reduce a likelihood of the transmit magnetic field 32 transmitted by the transmitter 2 being affected by a magnetic field from a different source. Examples of different sources include other magnetic field transmitters used for the same purpose as transmitter 2. Various examples of anti-collision module will be discussed in later parts of this specification. Note that the term anti-collision in this context is different from a prevention of a collision between two vehicles. The term anti-collision herein refers to anti-collision of magnetic fields. To avoid confusion, the collision between two vehicles will be referred to as vehicle collision, while the term anti-collision will be used for anti-collision of magnetic fields.

Vehicle 14 includes a receiver module 15 and warning device 16, both are powered by a power source 25. Power source 25 can be either the vehicle battery, or a power pack separate from the vehicle battery, or the combination of both.

Receiver module 15 includes a receiver 17, receive electronics 19, power module 21, and microcontroller 23. Power module 21 provides power to receive electronics 19 and microcontroller 23. Receive electronics 19 in combination with receiver 17, provides microcontroller 23 with a signal due to the transmit magnetic field 32. Depending on the application, receive electronics 19 may include a low-pass filter when the transmit magnetic field 33 is of a low frequency, for example 125 kHz, or tens to hundreds of kilo Hertz. The receiver 17 can take many forms, as long as it is considered by a person skilled in the art to be a magnetic field receiver.

Warning device 16 includes power module 27, microcontroller 29 and visual and/or audio output 31. Power module 27 provides power to microcontroller 29 and visual and/or audio output 31.

During an operation of the vehicle awareness system shown in FIG. 1*a*, vehicle 1 transmits a transmit magnetic field 32 when in operation. In one embodiment, vehicle 1 only transmits a transmit magnetic field when vehicle 1 is in motion. Alternatively, it is possible to have the transmit magnetic field 32 being transmitted all the time. Manual or automatic operation is possible, for example, a control button is switched by the vehicle operator or operated by the vehicle as a consequence of it being used.

Vehicle 14 will be able to monitor for the presence of transmit magnetic field 32 through its receiver 17. When a transmit magnetic field 32 is received by receiver 17 and a signal due to the transmit magnetic field 32 is provided to microcontroller 23 through receive electronics 19, microcontroller 23 will process the signal. One operation of the microcontroller 23 is to send a command to microcontroller 29 to control the operation of the visual and/or audio output 31 which is part of the warning device 16.

There can be various schemes regarding how frequently the microcontroller 23 sends data to microcontroller 29 and/or how the microcontroller 29 controls the visual and/or audio output 31 to provide an indication to an operator of vehicle 14. The operator of vehicle 14 can be the driver of vehicle 14, or a person controlling the movement of vehicle 14 remotely.

The various schemes include microcontroller 23 assessing the signal due to the transmit magnetic field 32, and only when one or more characteristics of the transmit magnetic field 32 matches one or more of the predetermined conditions (for example when the strength of the transmit magnetic field 32 exceeds a pre-programmed threshold), a command will be sent to microcontroller 29. Alternatively, microcontroller 23 may send all data to microcontroller 29 and let microcontroller 29 to do all the assessment. It is also possible to have microcontroller 23 and microcontroller 29 being a single controller.

Figure 1B:
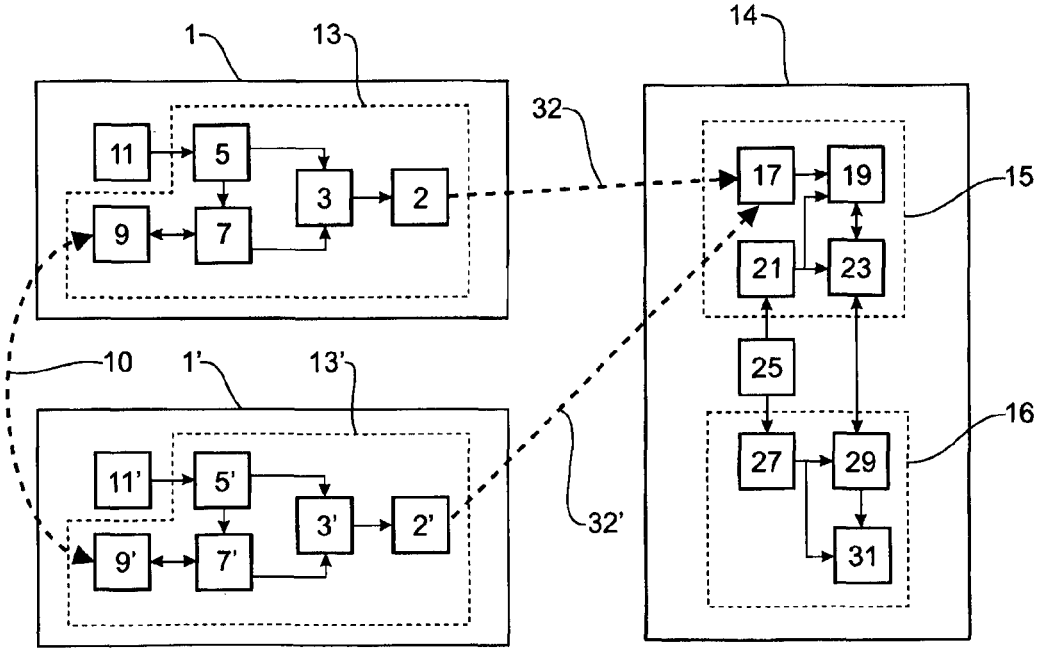
FIG. 1*b* shows an embodiment of a vehicle and person proximity awareness system where the anti-collision module includes a wireless communication module.

In essence, the operator of vehicle 14 will be alerted when vehicle 1 is within a predetermined proximity of vehicle 14. The anti-collision module 8 continuously monitors for the presence of any magnetic field which may affect the transmit magnetic field 32 (for example, a transmit magnetic field 32' transmitted from another vehicle 1' as shown in FIG. 1*b*). When such a presence is detected, the anti-collision module 8 will take appropriate actions to avoid having the transmit magnetic field 32 being affected by other magnetic fields. In short, anti-collision module 8 reduces a likelihood of the transmit magnetic field 32 being affected by a magnetic field from a different source. This helps to improve the reliability of the vehicle proximity awareness system. For example, if the transmit magnetic field 32 is affected (distorted, reduced in strength etc.), vehicle 14 may not know the presence of vehicle 1 even when vehicle 1 is within a proximity of vehicle 14.

FIG. 1*b* shows one embodiment of the anti-collision module 8 of FIG. 1*a* where the anti-collision module 8 now takes the form of a wireless communication module 9.

Also shown in FIG. 1*b* is vehicle 1' which includes a transmitter module 13', which is powered by a power source 11'. Transmitter module 13' includes a transmitter 2', transmit electronics 3', power module 5', microcontroller 7', and a wireless communication module 9'. These parts can be identical to those of vehicle 1 (where the anti-collision module 8 is replaced by wireless communication module 9, or can be similar to those of vehicle 1 as long as the core functions are the same).

Vehicle 14 of FIG. 1*b* is the same as that of FIG. 1*a*.

During operation, the wireless communication modules 9 and 9' will communicate with each other through a wireless communication link 10 to coordinate the transmission of transmit magnetic fields 32 and 32' through transmitter 2 and 2' respectively. The wireless communication link 10 may be based on various standards, such as Zigbee, WIFI (IEEE 802.11 standards) or any other proprietary protocols or standards.

In one embodiment, during operation, vehicles 1 and 1' communicate with each other so that transmitter 2 and 2' will not transmit at a same time, thus reducing the likelihood or risk of having the transmit magnetic fields 33 and 33' affecting one another. This will also ensure that vehicle 14 can detect a presence of both vehicle 1 and 1' when both vehicles are approaching vehicle 14 at a same time.

Alternatively, anti-collision module 8 can include a magnetic field monitoring module and a random number generator. Whenever the anti-collision module 8 detects a presence of a magnetic field which will affect the magnetic field to be transmitted by transmitter 2, it will generate a random number and wait for a period of time correspond to the generated random number. With all the vehicles which transmit magnetic field having such an anti-collision module, avoidance of having two vehicle transmitting at a same time can be achieved.

In one embodiment, the anti-collision module 8 need not include the ability to sense any magnetic field, rather it can communicate with a central control system which coordinates when the transmitter 2 can transmit. Such a central control system is possible when a mesh wireless network is implemented in a mine. More about a mesh wireless network is described with reference to FIG. 13.

Another alternative is to have the anti-collision module 8 applying a Time Division Multiple Access (TDMA) scheme. Such a scheme may be similar to that of mobile phone, or can be of a much simpler fashion. For example, it is possible to time-synchronise all the transmitting vehicles such that 1/10 of them is only using the first time slot out of a total of ten (or more) time slots to transmit, the next 1/10 of them using the second time slot etc. In another embodiment, the transmitter module synchronises the transmission of its magnetic field signal with all other transmitter modules in range by allocating up to eight 125 ms timeslots within each one second period according to the order of each transmitter MAC address. In one embodiment, if no other transmitter modules are in range, a transmitter module allocates and transmits on all 8 timeslots. In one embodiment, where eight or more transmitter modules are detected, a transmit module provides an error indication to the operator to indicate that one or more transmitter modules may not be detected. In another form, the priority of time slot selection is based on the order of globally unique MAC address or WIFI MAC address.

Figure 2:
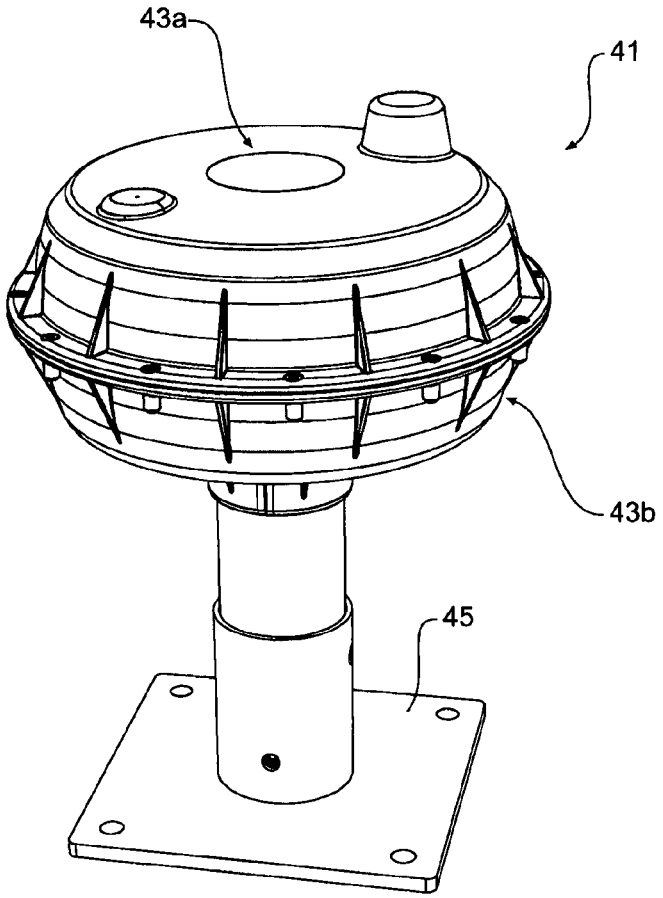
FIG. 2 shows a physical embodiment of a receiver module.

FIG. 2 shows a physical embodiment 41 of a receiver module 15. It includes generally an upper casing 43*a* and lower casing 43*b*, both when engaged form a protective outer casing for the components within receiver module 15, such as the receiver 17 and receive electronics 19. The casings protect the delicate internal circuitry against physical and environmental damage. It can be constructed of a durable PC/ASA blend flame retardant resin with featuring high UV resistance and exhibits minimal attention of electromagnetic radiation. Anchor 45 is to attach receiver module 15 to vehicle 14.

The receive module 15 may be fitted with an external LED status indicator (not shown). During normal operation the indicator flashes every a predetermined seconds (for example 3 sec). This indication may be used as part of the vehicle pre-start check to ensure that the device is functioning correctly. For example, if the LED status indicator is on continually, it may indicate that no warning device has been paired with the receiver module 15.

Figure 3:
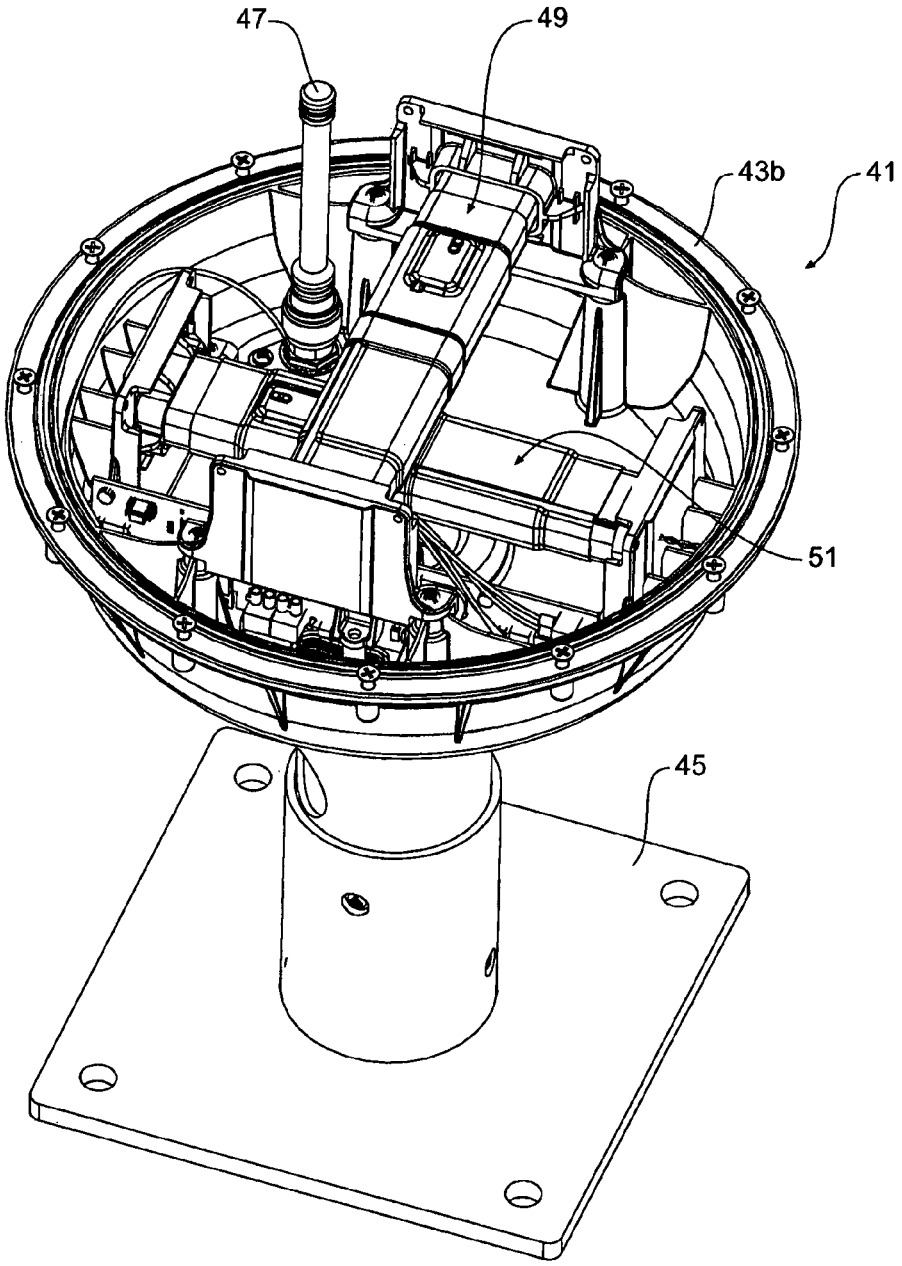
FIG. 3 shows the embodiment of FIG. 2 with upper casing removed.

FIG. 3 shows the embodiment 41 with upper casing 43*a* removed. In this embodiment, receiver 17 includes two antennas 49 and 51. Both antennas are orientated perpendicular to each other. The receiver 17 may concurrently measure the Received Signal Strength Indication (RSSI) for one or more magnetic signals from one or more transmitters (to be discussed further with reference to FIGS. 5 and 6) on two channels using the two antennas orientated perpendicular to each other.

While not shown in FIGS. 1*a* and 1*b*, this embodiment of receiver module 15 also includes a WIFI transceiver 47. It is useful for contacting various wireless access points in the mine which form a mesh wireless network. More about the mesh wireless network is described with reference to FIG. 13. The WIFI network can also be used to send signals to a particular transmitter including for example, acknowledgement signals.

Figure 4:
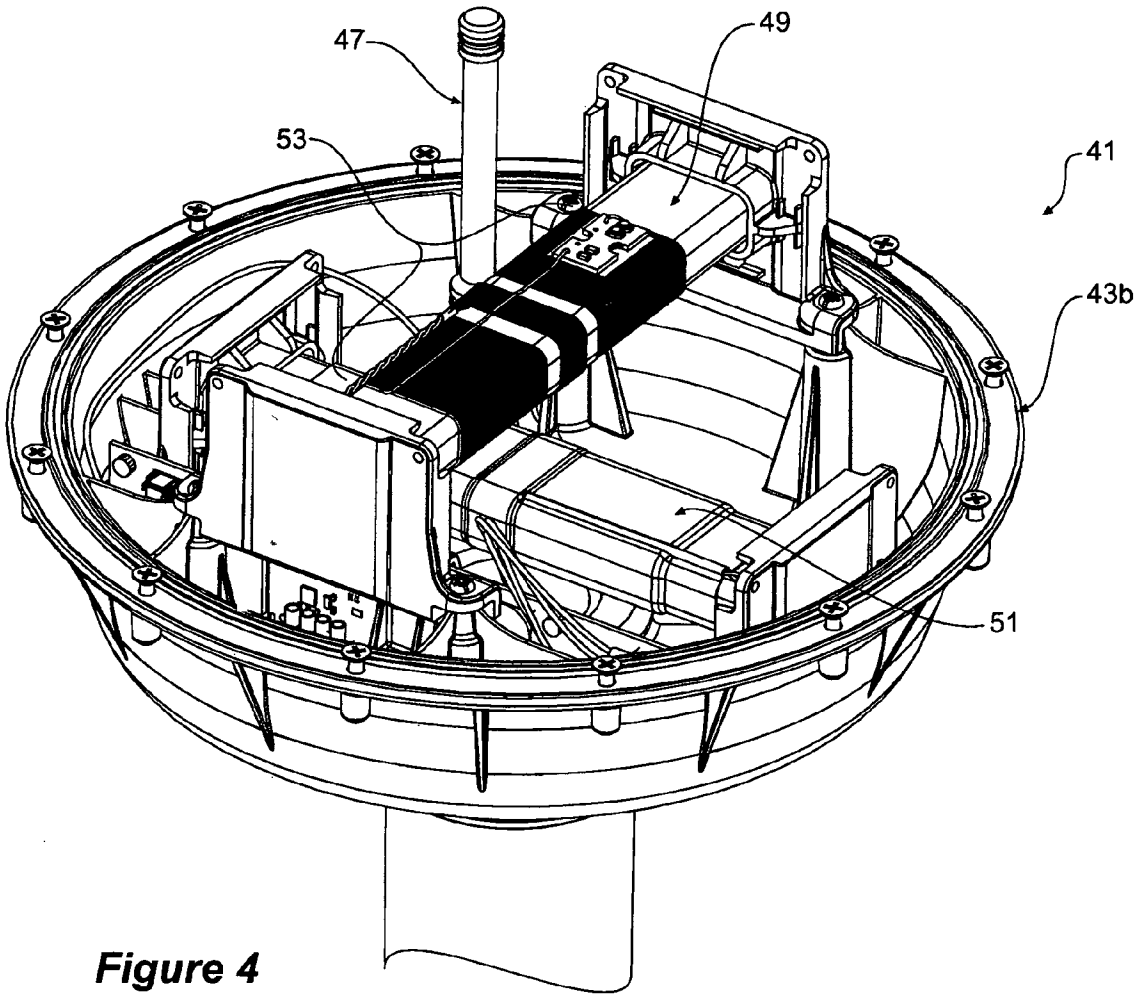
FIG. 4 depicts a close view of the embodiment of FIG. 2.

FIG. 4 depicts a close view of the embodiment shown in FIG. 3, showing the two antennas 49 and 51, which are orientated perpendicular to each other. However, FIG. 4 also shows the antenna 49 without its casing. It can be seen that, protected by its casing, antenna 49 includes coils of wire to form a multi-turn or multi-loop coil antenna 53.

Figure 5:
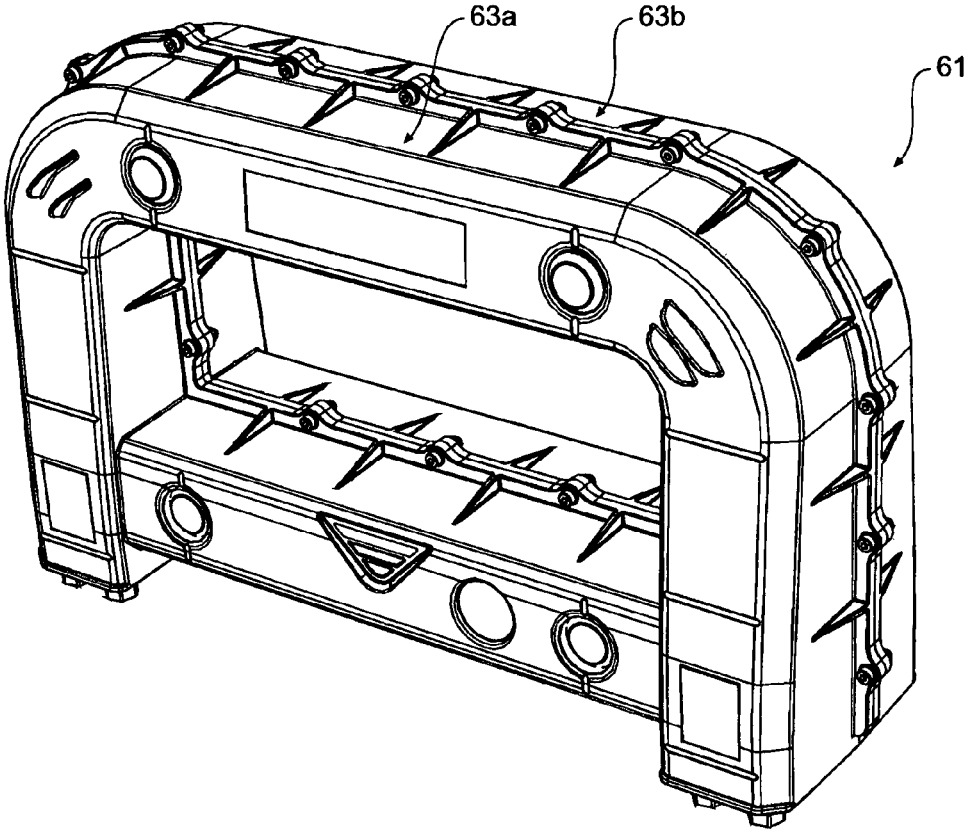
FIG. 5 shows a physical embodiment of a transmitter module.

FIG. 5 shows an embodiment 61 of a transmitter module 13 (referring to FIG. 1). It includes generally a front case 63*a* and rear casing 63*b*, both when engaged form a protective outer casing for the components within transmitter module 13, such as the transmitter 2 and transmit electronics 3. The casings protect the delicate internal circuitry against physical and environmental damage. It can be constructed of a durable PC/ASA blend flame retardant resin with featuring high UV resistance and exhibits minimal attention of electromagnetic radiation.

The transmitter module 13 may be fitted with an external LED status indicator that flashes on every transmission of the device. During normal operation with no other transmitter devices nearby, the LED status indicator flashes a predetermined times/second (for example, 8 times/second). This indication may be used as part of the vehicle pre-start check to ensure that the device is functioning correctly. For example, if the LED status indicator is off continually, it may indicate that he device is not transmitting.

Figure 6:
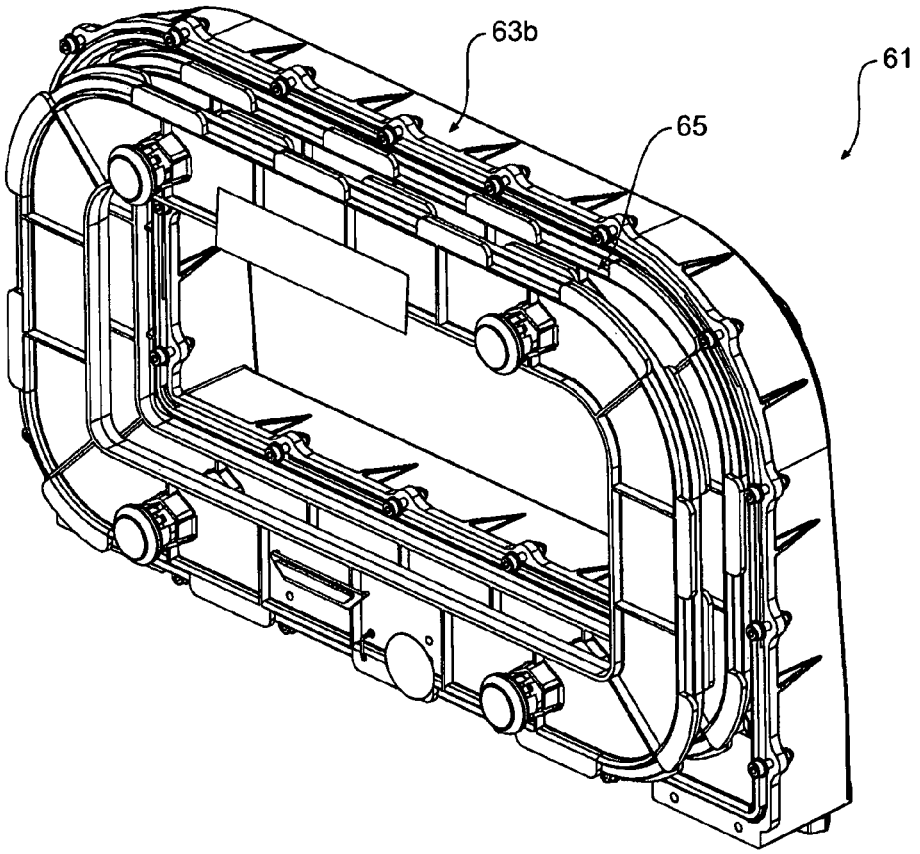
FIG. 6 shows the embodiment of FIG. 5 with front casing removed.

FIG. 6 shows the embodiment 61 with front casing 63*a* removed. This is to illustrate the wires 65 within the casings 63*a* and 63*b*, which form a transmitter coil. The coil can be of multi-turn or multi-loop coil.

Figure 7:
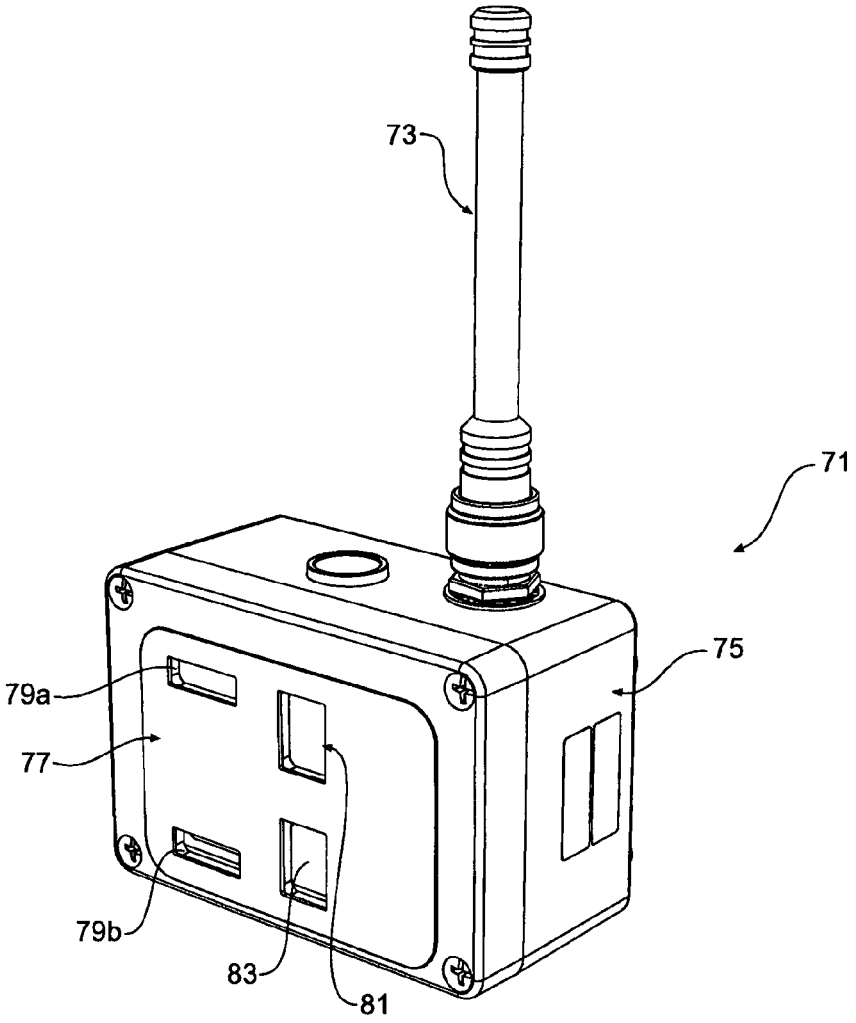
FIG. 7 depicts a physical embodiment of a warning device.

FIG. 7 depicts an embodiment 71 of a warning device 16. This embodiment 71 includes a WIFI transceiver 73, indicator panel 77, which includes screens 79*a* and 79*b* to indicate whether another vehicle is within a predetermined proximity of the vehicle fitted with the receiver module 15 and a warning device 16 installed, and whether the another vehicle is nearer to the front or rear of the vehicle having the receiver module 15 and the warning device 16 installed.

Indicator panel 77 also includes screen 81 to indicate the number of vehicles within the proximity, and screen 83 to indicate the number of a person bearing a personnel magnetic field transmitter within the proximity. Proximity is determined by the receipt and processing of the magnetic field from a transmitter. The casing 75 also includes a wireless or wired connection with the receiver module 15. The wireless connection will use the antenna 73 located on the casing 75. The brightness of the screens 79*a*, 79*b*, 81 and 83 may be adjusted depending on the environment, for example, the brightness is increased in a darkened environment.

In one embodiment, the distance of a transmitter module from a receiver module is used to define an alarm zone. For example, there may be 4 alarm zones with configurable threshold distances measured between the transmitter module and the receiver module, the zones being Stop zone (threshold 10 m), Alarm zone (threshold 25 m), Warn zone (threshold 35 m), and Alert zone (threshold 50 m). An appropriate alert is then sent to an operator/driver through a warning device for the operator/driver to take appropriate action. For example, when another vehicle is detected in an Alert zone, the operator/driver need not step on the brake, but should keep an eye on other vehicles, but when another vehicle is detected in a Stop zone, the operator/driver must step on the brake.

In one embodiment, the transmitter modules stores in non-volatile memory the information of Vehicle Type, Transmitter Location (Front/Back), The MAC addresses for all related devices (a transmitter modules/receivers/warning devices) fitted to the same vehicle, and its own MAC Address. The transmitter module transmits a WIFI Timeslot message to broadcast it's MAC address to other transmitter modules within range. The transmitter module also transmit magnetic signal to one or more receiver modules. A receiver module decodes from a magnetic signal transmitted by the transmitter module the information of Vehicle Type, Transmitter Location, all or part of the Transmitter/Transmitter Vehicle's Warning Device MAC Address (that is the MAC address of warning device fitted on a same vehicle with the transmitter, if any), and CRC. For optimisation, the receiver module may be configured to disregard magnetic signals received from MAC Addresses for devices fitted to the same vehicle. In this embodiment, upon receiving and processing a magnetic signal from a transmitter, the receiver module then transmits to the warning device through a link (such as RS-485 serial interface or WIFI) the information of Vehicle Type, Transmitter Location, all or part of the Transmitter/Transmitter Vehicle's Warning Device MAC Address, and Channel 1 and Channel 2 RSSI Values. Also, in this embodiment, the receiver module transmits to the source MAC Address of the magnetic signal via WIFI, all or part of MAC Address of warning device connected to the receiver module, and (Transmitter) Vehicle Type, Transmitter Location, all or part of the Transmitter/Warning Device MAC Address, and Channel 1 and Channel 2 RSSI Values. For each unique MAC Address received from the receiver module, the warning device combines the Channel 1 and Channel 2 RSSI values, determines the distance of the transmitter module, and determines the current Alarm Zone for the transmitter module, based on the Alarm Zone threshold values. It is also possible to determine allow the direction of a vehicle relative to another based on differential RSSI measurements from multiple transmitters/transmitter modules or receivers/receive modules on a single vehicle.

It is possible to have the receiver also transmit a signal via WIFI back to a warning device fitted to the same vehicle as the associated transmitter module but without a receiver, thus to allow alarming on vehicles without a receiver fitted.

Figure 8A:
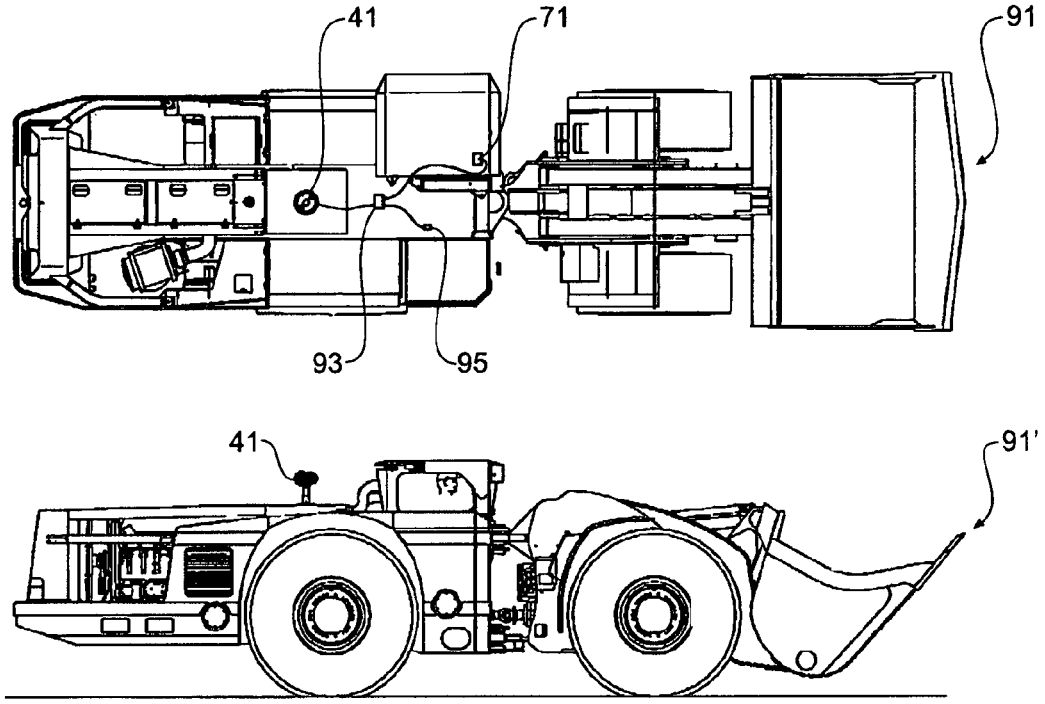
FIGS. 8(*a*) and (*b*) depict an embodiment showing how the receiver module, warning device and transmitter module are installed on vehicles.
Figure 8B:
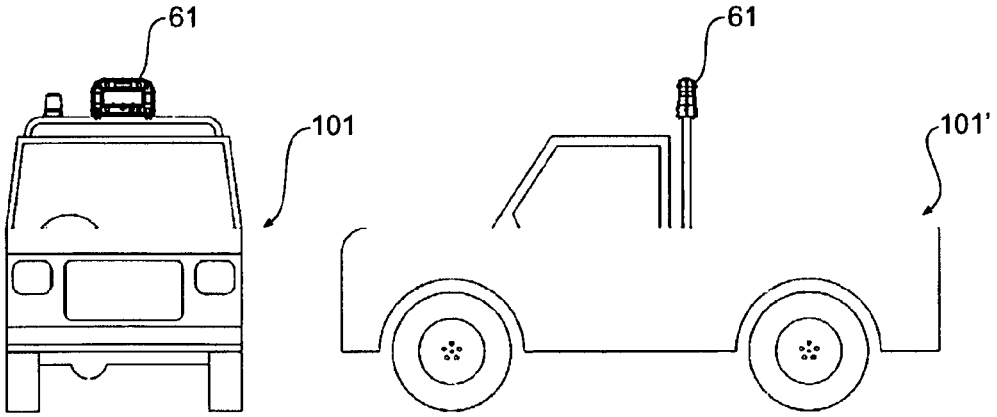

FIG. 8(*a*) depicts an embodiment showing how the receiver module 41, warning device 71 and transmitter module 61 are installed on vehicles. In this embodiment, a larger vehicle 91 (with a different view 91'), such as an earth excavator, etc, is equipped with the received module 41 as shown in FIG. 8(*a*). Also installed together with the receiver module 41 is warning device 71 located within audible and visual range of the vehicle operator (when the vehicle is remotely operated the receiver module would be located adjacent the remote operator or incorporated into their operator console or that same functionality incorporated into the remote operator software and thus able to alert the operator through the graphical user interface). They can be connected wirelessly or through wired connection as shown in FIG. 8(*a*) where a junction box 93 links the receiver module 41 to warning device 71. The junction box 93 is also connected to an ignition terminal of the vehicle so that the devices are powered only when the vehicle is being operated.

A smaller vehicle, such as a utility or a human transport vehicle 101 (with a different view 101') is with a transmitter module installed as shown in FIG. 8(*b*). The transmitter is installed with the plane of the coil of the transmitter being perpendicular to the movement direction of the vehicle.

With such arrangement where the larger vehicles are fitted with the receiver modules, the drivers of the larger, heavier vehicles are assisted to avoid collision with the smaller vehicles fitted with the transmitter modules.

It is also possible to reverse the arrangement where the smaller vehicles are equipped with the receiver module and the warning device, and with the larger vehicle installed with the transmitter module.

It is also possible to have a criterion for selecting which vehicle is to be equipped with the receiver module and warning device or the transmitter module. For example, a more frequently used vehicle may be equipped with a receiver module and a warning device, rather than a transmitter module, or the other way round. It is also possible to have all vehicles having all of receiver module, warning device, and transmitter module installed in each vehicle.

Figure 9:
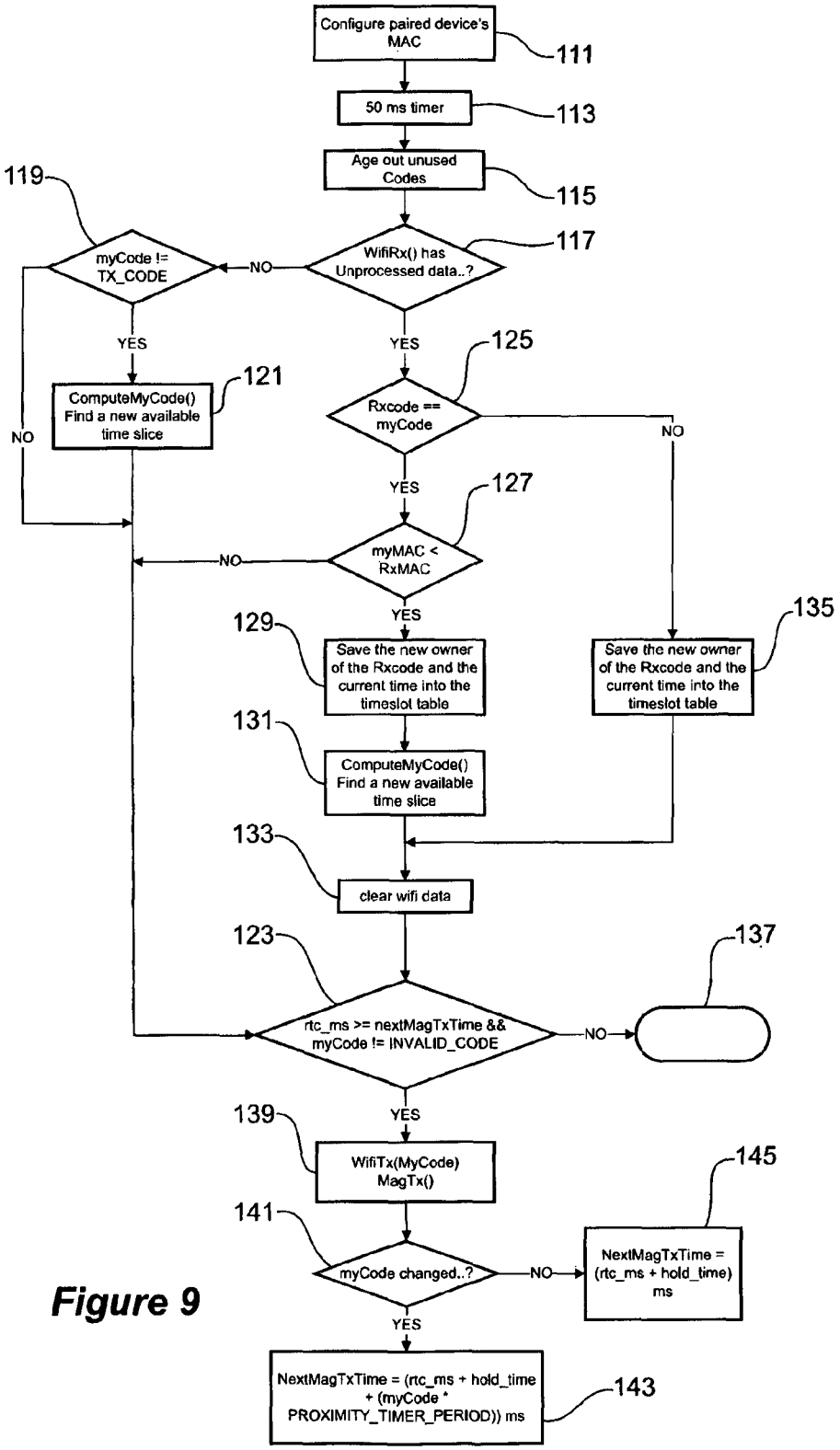
FIG. 9 depicts a flow chart of one embodiment of a software system for the transmitter module.

FIG. 9 depicts a flow chart of one embodiment of a software system for the transmitter module. This embodiment includes the WIFI anti-collision system described with reference to Figure 1*b*. This flow chart contains many sub-functions which are not necessarily essential for the working of a transmitter module. Thus, this flow chart merely provides a working example and should not be taken as the only way to perform the invention described herein.

At the beginning of a repeating function, the software will configure the MAC of the paired transmitter modules 111, if any. It will then start a 50 ms timer 113, and then age out all the unused codes 115. It will then check whether there is any data received through the WIFI wireless communication 117. If there is no data, it will check whether myCode is equal to TX_CODE 119 (note that myCode is initially set as TX_CODE). This step is to check whether the time slot or time slice is available. If it is not equal, it will find a new available time slice 121. If it is equal (the "No" path), or the step 121 has found a new available time slice, it will proceed to step 123, where further checks are performed, the checks including whether there is sufficient time to transmit, and whether there is any red flag or invalid code received. If step 123 fails, the whole function will end 137 and will again restart from step 111. If step 123 does not fail, it will proceed to step 139 during which the WIFI module will transmit an announcement that the transmitter module will transmit a magnetic field, so that other nearby transmitter modules will not transmit following the receipt of the announcement. After transmission during step 139, the system will perform further checking steps to control the next transmission time (for example steps 141, 143 and 145 as shown).

However, when there is data received through the WIFI communication link during step 117. It will check whether the received code (Rxcode) equals to myCode125. If it does not equal, the system will save the new owner of the Rxcode and the current time into a timeslot table 135 and the WIFI data received through the wireless communication link will be cleared 133 and the software progresses to step 123 described above. If it does equal, the system will check whether myMac is lesser than RxMac 127. If it is larger, the system moves to step 123 described above. If it is lesser, it will save the new owner of the Rxcode and the current time into a timeslot table 129, find a new available timeslot 131 and progress to step 133 described above.

Figure 10:
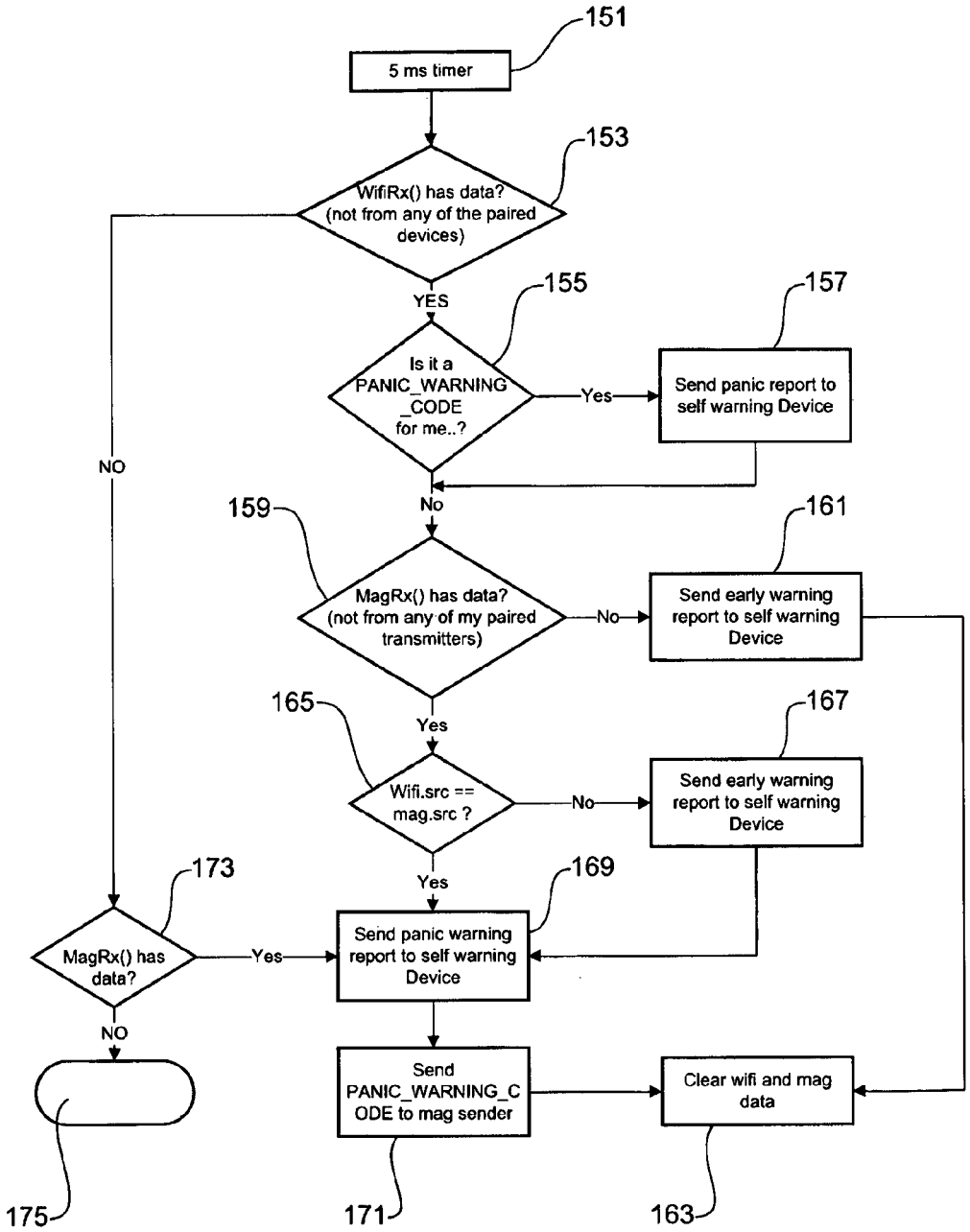
FIG. 10 depicts a flow chart of one embodiment of software system for the receiver module.

FIG. 10 depicts a flow chart of one embodiment of software system for the receiver module. Similar to the transmitter module embodiment shown with respect to FIG. 9, this embodiment is having the WIFI anti-collision system described with reference to FIG. 1*b*. This flow chart contains many sub-functions which are not necessarily essential for the working of a receiver module. Thus, this flow chart merely provides a working example and should not be taken as the only way to perform the invention described herein.

When the system starts, it will wait for 5 ms 151. Then it will check whether there is any data received through its WIFI communication 153 (excluding data received from its paired warning device). If there is no data, it will check whether there is any presence of a transmit magnetic field 173. If there is none, the function will stop 175 and restarts from step 151.

If there is data received through the WIFI communication system in step 153, it will check whether it is a panic warning code (or real warning code) 155, if yes, it will send a panic report to the paired warning device 157. If no, or after sending the panic report 157, it will check whether there is any detected transmit magnetic field 159. If no, an early warning report is sent to the paired warning device 161, and the WIFI data and any data related to any detected magnetic field is cleared 163. If yes to step 159, it will check whether the WIFI source and the magnetic field course are the same 165. If they are not, an early warning report is sent to warning device 167 followed by sending panic warning report to warning device 169. If they are the same, only the panic warning report is sent 169. The function will also send a PANIC_WARNING_CODE the magnetic field transmitter as an acknowledgement, if there are means to do so, before ending the routine with step 163 described above.

Figure 11:
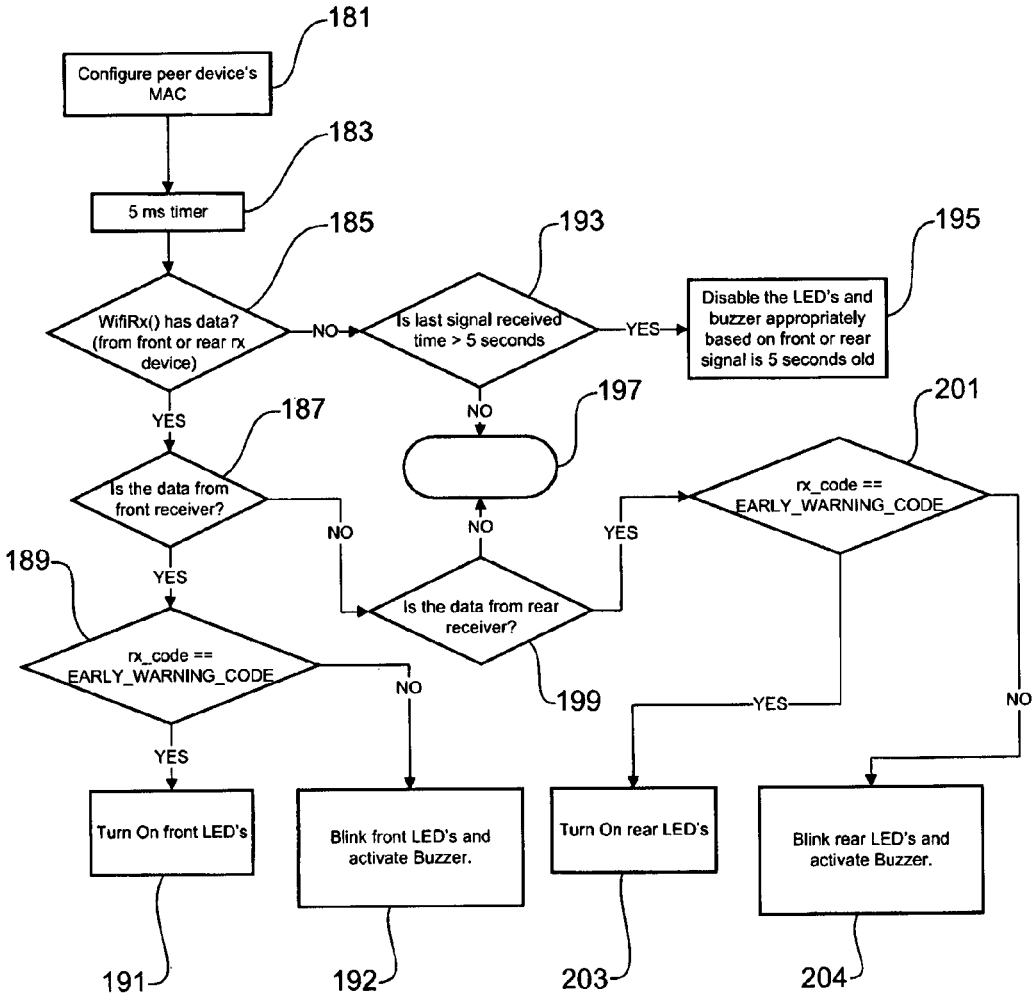
FIG. 11 depicts a flow chart of one embodiment of software system for the warning device.

FIG. 11 depicts a flow chart of one embodiment of software system for the warning device. The warning device also includes a WIFI capability. This flow chart contains many sub-functions which are not necessarily essential for the working of a transmitter module. Thus, this flow chart merely provides a working example and should not be taken as the only way to perform the invention described herein.

At the beginning of a repeating function, the software will configure the MAC of the warning device and the received module 181. After that and after a 5 ms timer 183, it will check whether there is any data received through the WIFI wireless communication link 185. The data can be used to identify whether the vehicle within proximity is nearer to the front or the rear through step 187. The data can also be used to check whether it is an early warning code or it is a real warning code. For example, if the data is received from the front, through for example a use of multiple directional antennas, step 189 checks whether it is an early warning code 189, and if yes, a light will be switched on 191. If it is not an early warning code, it means that the warning code is a real warning code and it will blink light and active buzzer 192. Similarly, if the data is receive from the back, step 199 checks whether it is an early warning code 201, and if yes, a light will be switched on 203. If it is not an early warning code, it means that the warning code is a real warning code and it will blink light and active buzzer 204.

If the data is not relating to the front or the back, the function will stop 197, and the function will restart from 181.

If no data is detected in step 185, and if the last signal is received less than 5 seconds 193, the function will stop 197, and the function will restart from 181. If it is more than 5 seconds, the lights (LEDs) will be disabled and the buzzer will be switched off 195.

The software on each device may be re-programmable via an interface to a Trivial File Transfer Protocol (TFTP)

Server application through a 802.11g WIFI wireless access point to perform functions described herein but not shown in flowcharts 9 to 11, for example, flowchart 11 can be reprogram to implement Alarm Zone described previously. The wireless access point used for software upgrade may be configured with a default Service Set Identification (SSID) of 'MTC'. The TFTP Server application used may have a DHCP Server function to dynamically assign an IP address to the target hardware device for the software upgrade process.

The vehicle proximity awareness system described herein has a functional detection distance (which is how far a receiver can detect a transmit magnetic field from a transmitter) of approximately 40 m and an alarm range of 35 m or less, when applied in an underground mining environment. If the WIFI anti-collision solution is chosen, the ideal functional distance of the WIFI will usually be greater than the functional detection distance, with the functional distance of the WIFI being approximately between 50 m to 100 m.

The functional distance of the WIFI is not reliable and is unpredictable when operated underground as the performance of WIFI is dependent largely on line-of-sight, and the corners of connecting tunnels within a mine would restrict line-of-sight. However, this will be acceptable in practice as there is less transmitter density underground.

On the other hand, when in an above ground condition, a different problem arises though the performance of the WIFI would be more predictable and reliable as compared to its performance when underground. The problem is that there will be unobstructed line-of-sight when above ground. Consequently, the WIFI of a transmitter will too often indicate that there is another transmitter nearby, as the effective functional distance of the WIFI will be 100 m or more. The adverse effect is that the transmitter may be struggling to find an available time slot (if a TDMA scheme is used) when the WIFI indicates that there are many other transmitters within the functional distance of the WIFI. In a worst case, the WIFI anti-collision solution will not be effective, as too often a transmitter can't find an available slot to transmit when too many transmitters are competing for a limited number of time slots.

Figure 12:
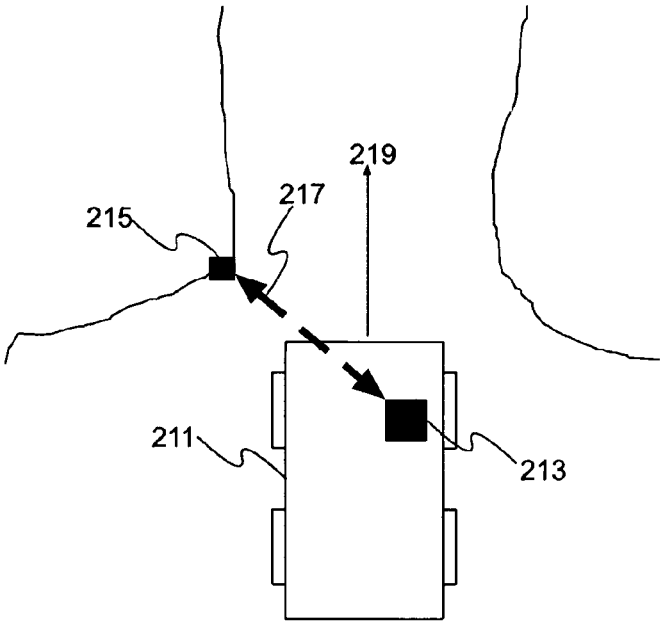
FIG. 12 depicts how a vehicle with a transmitter or receiver module can interact with an access point.
Figure 13:
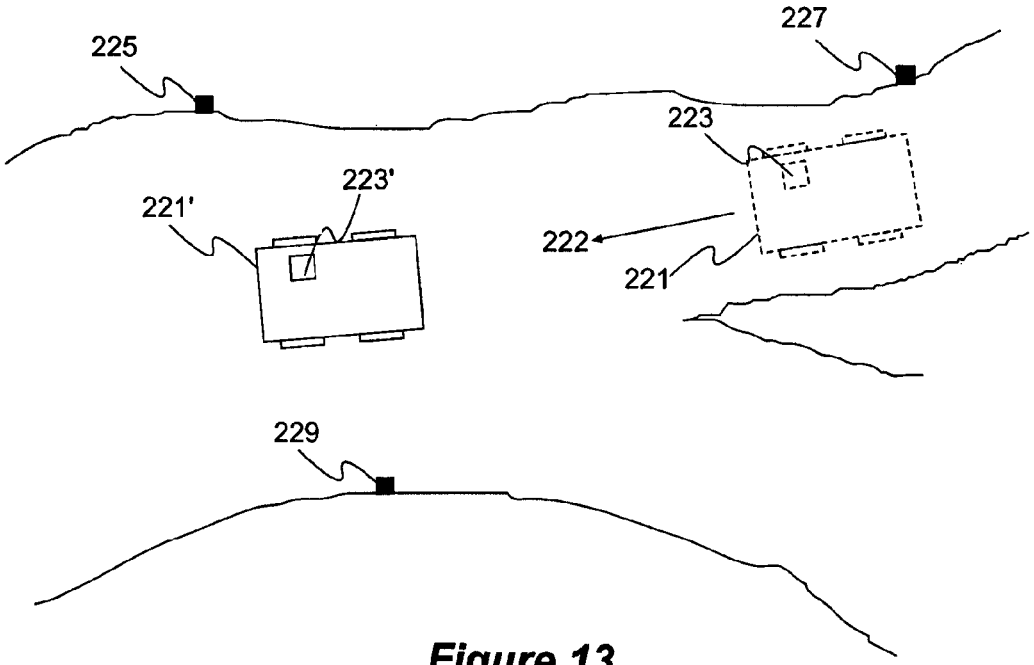
FIG. 13 depicts a tracking of a vehicle using a mesh wireless network.

A solution for this kind of above the ground problem is to enable a mesh wireless network in a mine by setting up wireless access points at various locations of the mine (both underground and above the ground). Such a mesh wireless network can offer the following advantages:

i) Solves the problem where a transmitter can't find an available time slot for transmission when operated above the ground—When a vehicle is above the ground, it will switch to an above the ground mode. During this mode, it will actively communicate with one or more access points. By doing so the position of the vehicle can be known to a central system, and the relative positions of other vehicles can be known to that vehicle too. By computing the relative positions, the warning device can alert the driver appropriately. Alternatively, the central system can send a warning signal to the vehicle when other vehicles are nearby.

ii) Allows gateway system—Passing vehicles know they are entering a certain zone. FIG. 12 shows an example illustrating this point. Vehicle 211 with a transmitter module or a receiver module 213 can receive a signal from an access point 215 through WIFI communication link 217, when vehicle 211 is entering an entrance 219, for example, of a mining tunnel. The access point is connected to a central system. Thus, vehicle 211 can be alerted when there is a hazardous situation ahead.

iii) Tracks movement of a vehicle (both underground and above ground)—As shown in FIG. 13, the system can track the real-time location of a vehicle with a transmitter module or a receiver module with wireless communication capability to establish wireless communication link with the access points within a mesh wireless network in the mine. In this example, access points 225, 227 and 229 are parts of a mesh wireless network. A vehicle 221 with a transmitter module or a receiver module 223 with a WIFI capability, moving in direction 222 can be tracked. As vehicle 221 moves away from near access point 227 to a position near access point 225 indicated by 221' and 223', the communication link with the mesh wireless network will switch from access point 227 to access point 225 and/or access point 229. Thus the central system will know that vehicle is moving in direction 222.

The present invention can be applied to a personnel magnetic field transmitter bearable by a mining worker. For example, it is possible to have a worker wearing a personnel magnetic field transmitter such that a magnetic field receiver fitted on a vehicle is capable of receiving a magnetic field transmitted from the personnel magnetic field transmitter. By having such personnel magnetic field transmitter, the driver/operator of a vehicle will be made alert of the presence of a worker near the vehicle.

A detailed description of one or more preferred embodiments of the invention is provided above along with accompanying Figures that illustrate, by way of example, the principles of the invention. While the invention is described in connection with such embodiments, it should be understood that the invention is not limited to any embodiment. On the contrary, the scope of the invention is limited only by the appended claims and the invention encompasses numerous alternatives, modifications, and equivalents. For the purpose of example, numerous specific details are set forth in the description above in order to provide a thorough understanding of the present invention. The present invention may be practised according to the claims without some or all of these specific details. For the purpose of clarity, technical material that is known in the technical fields related to the invention has not been described in detail so that the present invention is not unnecessarily obscured.

Throughout this specification and the claims that follow, unless the context requires otherwise, the words 'comprise' and 'include' and variations such as 'comprising' and 'including' will be understood to imply the inclusion of a stated integer or group of integers, but not the exclusion of any other integer or group of integers.

The reference to any prior art in this specification is not, and should not be taken as, an acknowledgment or any form of suggestion that such prior art forms part of the common general knowledge of the technical field.

We claim:

1. A vehicle proximity awareness system in a mine, including:

a magnetic field transmitter on a first vehicle for transmitting a transmit magnetic field, the magnetic field transmitter including an anti-collision capability for reducing a likelihood of the transmit magnetic field being affected by a presence of a magnetic field from a different source;

a magnetic field receiver on a second vehicle for receiving the transmit magnetic field from the first vehicle to provide a receive signal;

a processor on the second vehicle for processing the receive signal, and for providing an indication to an operator of the second vehicle when the first vehicle is within a proximity of the second vehicle;

a wireless network in the mine for tracking the location of the first vehicle, the second vehicle, or both; and a wireless communication module for providing control signals to the magnetic field transmitter and for communicating wirelessly with the different source without affecting or being affected by the transmit magnetic field;

wherein the transmit magnetic field is transmitted in accordance with the anti-collision capability, and not in response to a detection of the presence of the magnetic field from the different source; and wherein the anti-collision capability is based on a communication, between the wireless communication module and the different source, to avoid having the magnetic field transmitter and the different source transmitting at a same time.

2. The vehicle proximity awareness system of claim 1, wherein the wireless communication link is based on IEEE 802.11 standards.

3. The vehicle proximity awareness system of claim 1, wherein the magnetic field receiver is adapted such that the indication is capable of indicating a direction of the first vehicle relative to the second vehicle.

4. The vehicle proximity awareness system of claim 3, wherein the indication is further capable of indicating whether the first vehicle is closer to the rear or front of the second vehicle.

5. The vehicle proximity awareness system of claim 3, wherein the indication is further capable of indicating the number of vehicles transmitting a magnetic field within the proximity of the second vehicle.

6. The vehicle proximity awareness system of claim 1, further including:

a WIFI module for transmitting from the second vehicle a WIFI signal back to the first vehicle alerting an operator of the first vehicle that the second vehicle is within a proximity of the first vehicle.

7. The vehicle proximity awareness system of claim 1, wherein the magnetic field transmitter includes a coil positioned on substantially the top of the first vehicle, with a plane of the coil being substantially perpendicular to a movement direction of the first vehicle.

8. The vehicle proximity awareness system of claim 1, wherein the magnetic field receiver includes two antennas positioned substantially perpendicular to each other.

9. The vehicle proximity awareness system of claim 8, wherein the two antennas measure concurrently a Received Signal Strength Indication (RSSI) for one or more magnetic signals on two different channels.

10. The vehicle proximity awareness system of claim 1, further including:

a personnel magnetic field transmitter bearable by a mining worker;

wherein the magnetic field receiver is capable of receiving a magnetic field transmitted from the personnel magnetic field transmitter.

11. The vehicle proximity awareness system of claim 1, wherein the different source is a magnetic field transmitter on a third vehicle.

12. The vehicle proximity awareness system of claim 1, further including a wireless mesh network for tracking the first vehicle and/or the second vehicle.

13. The vehicle proximity awareness system of claim 1, further including a transceiver at a location for sending information to the first vehicle and/or the second vehicle when the first vehicle and/or the second vehicle is within a distance from the location.

14. The vehicle proximity awareness system of claim 13, wherein the information includes a warning signal to the first vehicle and/or the second vehicle.

15. The vehicle proximity awareness system of claim 13, wherein the location is an entrance to a mining tunnel.

16. A vehicle in a mine, including:

a magnetic field transmitter for transmitting a transmit magnetic field, the magnetic field transmitter including an anti-collision capability for reducing a likelihood of the transmit magnetic field being affected by a presence of a magnetic field from a different source; the transmit magnetic field for providing a signal to another vehicle for processing to provide an indication to an operator of the other vehicle when the vehicle is within a proximity of the other vehicle; wherein the transmit magnetic field is transmitted in accordance with the anti-collision capability, and not in response to a detection of the presence of the magnetic field from the different source; and wherein the magnetic field transmitter works with a wireless network in the mine such that the vehicle can be tracked using the wireless network; and a wireless communication module for providing control signals to the magnetic field transmitter and for communicating wirelessly with the different source without affecting or being affected by the transmit magnetic field;

wherein the anti-collision capability is based on a communication, between the wireless communication module and the different source, to avoid having the magnetic field transmitter and the different source transmitting at a same time.

17. A magnetic field transmitter for a proximity awareness system in a mine, including:

a magnetic field transmitter for transmitting a transmit magnetic field, the magnetic field transmitter including an anti-collision capability for reducing a likelihood of the transmit magnetic field being affected by a presence of a magnetic field from a different source; the transmit magnetic field for providing a signal to a vehicle for processing to provide an indication to an operator of the vehicle when the magnetic field transmitter is within a proximity of the vehicle; wherein the transmit magnetic field is transmitted in accordance with the anti-collision capability, and not in response to a detection of the presence of the magnetic field from the different source; and wherein the magnetic field transmitter works with a wireless network in the mine such that a vehicle can be tracked using the wireless network; and a wireless communication module for providing control signals to the magnetic field transmitter and for communicating wirelessly with the different source without affecting or being affected by the transmit magnetic field;

wherein the anti-collision capability is based on a communication, between the wireless communication module and the different source, to avoid having the magnetic field transmitter and the different source transmitting at a same time.

18. A method for implementing a vehicle proximity awareness system in a mine, including the steps of:

transmitting from a first vehicle a transmit magnetic field;

having at the first vehicle an anti-collision capability for reducing a likelihood of the transmit magnetic field being affected by a presence of a magnetic field from a different source;

receiving at a second vehicle the transmit magnetic field to provide a receive signal; and processing the receive signal and providing an indication to an operator of the second vehicle when the first vehicle is within a proximity of the second vehicle;

communicating wirelessly with the different source without affecting or being affected by the transmit magnetic field; and tracking, using a wireless network, the location of the first vehicle, the second vehicle, or both;

wherein the transmit magnetic field is transmitted in accordance with the anti-collision capability, and not in response to a detection of the presence of the magnetic field from the different source; and wherein the anti-collision capability is based on a communication, between the wireless communication module and the different source, to avoid transmitting the transmit magnetic field and transmitting the magnetic field from the different source at a same time.

* * * * *